US007723628B2

(12) United States Patent
Jarrett

(10) Patent No.: US 7,723,628 B2
(45) Date of Patent: May 25, 2010

(54) REMOTELY CONFIGURABLE CONTROL LEVER

(75) Inventor: Tim Jarrett, Colchester (GB)

(73) Assignee: CNH America LLC, New Holland, PA (US)

( * ) Notice: Subject to any disclaimer, the term of this patent is extended or adjusted under 35 U.S.C. 154(b) by 582 days.

(21) Appl. No.: 11/799,852

(22) Filed: May 2, 2007

(65) Prior Publication Data

US 2007/0284237 A1 Dec. 13, 2007

(30) Foreign Application Priority Data

May 5, 2006 (GB) ..... 0608814.0

(51) Int. Cl.
*H01H 3/04* (2006.01)
*H01H 3/20* (2006.01)
*G05G 5/02* (2006.01)

(52) U.S. Cl. ..... 200/332; 200/335; 200/61.88; 200/318; 200/323; 200/324; 74/529; 335/205

(58) Field of Classification Search ..... 74/527, 74/529, 531–536, 540, 541; 267/150; 335/205–207; 200/43.16, 43.19, 61.54, 61.85, 61.86, 61.88, 200/332, 335, 318, 321–327
See application file for complete search history.

(56) References Cited

U.S. PATENT DOCUMENTS

| | | | | |
|---|---|---|---|---|
| 4,438,660 | A | 3/1984 | Kittle | |
| 4,440,040 | A | 4/1984 | Kittle | |
| 5,791,200 | A * | 8/1998 | Papasideris | 74/529 |
| 6,260,436 | B1 * | 7/2001 | Sander et al. | 74/529 |
| 6,684,730 | B2 * | 2/2004 | Giefer et al. | 74/473.23 |
| 7,243,575 | B2 * | 7/2007 | Niederwimmer | 74/745 |
| 7,320,263 | B2 * | 1/2008 | Gustafsson | 74/471 XY |
| 7,530,286 | B2 * | 5/2009 | Howe et al. | 74/473.21 |

* cited by examiner

*Primary Examiner*—Michael A Friedhofer
(74) *Attorney, Agent, or Firm*—Patrick M. Sheldrake; John William Stader; Michael G. Harms

(57) ABSTRACT

A remotely configurable control lever is disclosed for operating an electrical switch on the control panel of an agricultural vehicle. A cam plate 22 rotatable with the control lever has a cam track 23 defining at least one notch, which is selectively engaged by a resiliently biased detent 24 to latch the control lever in a predetermined position. A solenoid 32 is provided for retracting the detent to allow the control lever 10 to return to a neutral position. A second cam track 123 is provided which is rotatable with the control lever 10 and defines at least one stop cooperating with a further retractable detent 124 to limit the range of angular displacement of the control lever 10.

4 Claims, 2 Drawing Sheets

REMOTELY CONFIGURABLE CONTROL LEVER

FIELD OF THE INVENTION

The present invention relates to a remotely configurable control lever. The lever is suitable for the operation of an electrical switch on the control panel of an agricultural vehicle and will be described in that context. The control lever is not, however, restricted to such an application and it may be used for example to operate hydraulic or pneumatic valves in other environments.

BACKGROUND OF THE INVENTION

In an agricultural vehicle, there are numerous operations that need to be performed by the use of switches. As a consequence, the space available on the control panel to accommodate the various switches is at a premium. If one has dedicated switches for each of the different functions, inevitably some will need to be located in inconvenient positions for the operator.

It has already been proposed to mitigate this problem by the use of a configurable switch. A multi-function switch is ergonomically positioned and the function that it performs in any mode is determined by the control system to which it is connected. Hence, the same switch can be used in one mode to control a front PTO (power take-off) and in another to control, for example, the operation of the electro-hydraulic remotes.

It is straightforward, especially when the control system is computerized, to modify the way that the switch functions electrically, so that in the example given above its output is sent in the first mode to the front PTO and in another mode to one of the electro-hydraulic remotes.

It is not however sufficient to change the way in which a switch operates electrically, the manner that its control lever moves mechanically needs also to be modified to suit the task at hand, so as to operate in the same manner as a switch dedicated to that task. Depending on the task, one or more of the switch positions may need to be changed from latched to spring biased, also termed a momentary position. If a positioned is latched, the switch acts as an ON/OFF switch and remains in the position in which its control lever is left. If it is momentary, the switch will only remain in an ON position until the control lever is released, whereupon it will automatically return to a neutral rest position.

Configurable switches have previously been disclosed in the prior art, for example in U.S. Pat. No. 4,438,660 and U.S. Pat. No. 4,440,040, in which a switch position can be changed from a latched position to a spring biased position. A switch that is in current production and is believed to represent the closest prior art to the present invention is shown schematically in FIG. 1 of the accompanying drawings.

In FIG. 1, a control lever 10 is pivotably mounted in a switch housing 12 having an external electrical connector 16. Within the housing 12, there is mounted a potentiometer and electrical switch module 18 connected by multiple wires 20 to the connector 16. The internal construction of the switch module 18 is not material to the present invention and it may typically have a wiper arm movable by the control lever 10 which contacts a resistive track to produce a continuously variable resistance on one output lead. In different positions of the control lever 10, the wiper arm closes switch contacts. The variable resistance output of the switch can be used to corroborate the control lever position to safeguard against erroneous states of the switch contacts, caused by a short circuit or an open circuit in the internal wiring of the switch.

The spindle of the control lever 10 that moves the wiper arm of the switch module is connected to a cam plate 22 shown separately in FIG. 2. The cam plate 22 has a cam track 23 defining three notches marked R, F and EF which correspond respectively to a reverse, forward and an extended forward position of the lever 10 and a further section defining a central position N corresponding to a neutral position of the control lever 10. A detent 24 is mounted in the housing 12 for pivoting movement about a pin 27 and is biased towards the cam track 23 by means of a spring plate 26 which is pivotable in the housing 12 about a pin 25. The opposite end of the spring plate 26 rests on a catch 28 which is pivotable in the housing 12 about a further pin 29. A coil spring 30 acts between the catch 28 and the spring plate 26 to urge the latter clockwise as viewed in the drawing. Pivoting of the latch about the pin 29 is effected by means of the armature pin 33 of a solenoid 32 which is connected by further wires 34 to the connector 16.

In FIG. 1, the lever arm is latched in the forward position. The latching is effected by the detent 24 which is biased by means of the spring plate 26 to engage in the notch F in the cam track 23. In the same way, if the control lever 10 is moved to the reverse or extended forward positions, it will be latched in those positions in the same manner. The lever 10 is biased by a separate centering spring into its central neutral position and there is no notch required in the cam plate 22 to latch the lever 10 in the central or neutral position.

To configure the control lever so that it returns to its neutral position whenever it is released, the solenoid 32 is remotely activated to pivot the catch 28 anticlockwise as viewed. The catch 28 will then release the end of the spring plate 26 which will be free to pivot anticlockwise about the pin 25. The detent 24 is now only held against the cam track 23 by the force of the weak spring 30. The centering spring acting on the control lever 10 is able to overcome the force of the detent 24 so that the control lever 10 can no longer be latched by the detent 24 in any of the reverse, forward or extended forward positions. The solenoid 32 can be operated at any time when the control lever 10 is latched so that it can act as an override to return or kick-out the control lever 10 to the neutral position whenever necessary, for example to ensure that the control lever is in the neutral position prior to the engine being started.

Because the position of the control lever 10 is known from the variable resistance output of the switch module, it is possible to engage and disengage the detent 24 as a function of lever position so that, for example, the forward and reverse positioned may be latched and the extended forward position spring biased.

It has been assumed that the same detent 24 engages all three of the notches in the cam track but a further possibility is to have the notches in different planes and engaged by separate detents 24 so that each position of the control lever may be set to latched or momentary independently of the setting of the other positions.

A disadvantage of the described configurable switch is that regardless of its operating mode, the control lever can always be moved to four positions. If a task only requires a two or three position switch, the control lever will have redundant positions and these have been found to be confusing to the operator.

SUMMARY OF THE INVENTION

According to the present invention, there is provided a remotely configurable control lever for operating an electrical switch on the control panel of an agricultural vehicle, comprising a cam plate rotatable with the control lever and having a cam track defining at least one notch, a resiliently biased detent cooperating with the notch to latch the control lever in a predetermined position, and a solenoid for retracting the detent to allow the control lever to return to a neutral position, characterized in that a second cam track is provided which is rotatable with the control lever and defines at least one stop cooperating with a retractable detent to limit the range of angular displacement of the control lever.

In the case of a control lever used to operate a switch having neutral, reverse, forward and extended forwarded, the second cam track may be operative to prevent the control lever from moving to the reverse position when engaged by the detent and to enable the control lever to reach the reverse position when the detent is retracted.

If desired, the second cam track may have a second stop to inhibit the neutral and reverse positions of the control lever and only allow movement of the control lever between the forward and extended forward positions.

BRIEF DESCRIPTION OF THE DRAWINGS

The invention will now be described further, by way of example, with reference to the accompanying drawings, in which.

DETAILED DESCRIPTION OF THE PREFERRED EMBODIMENT

Figure 1:
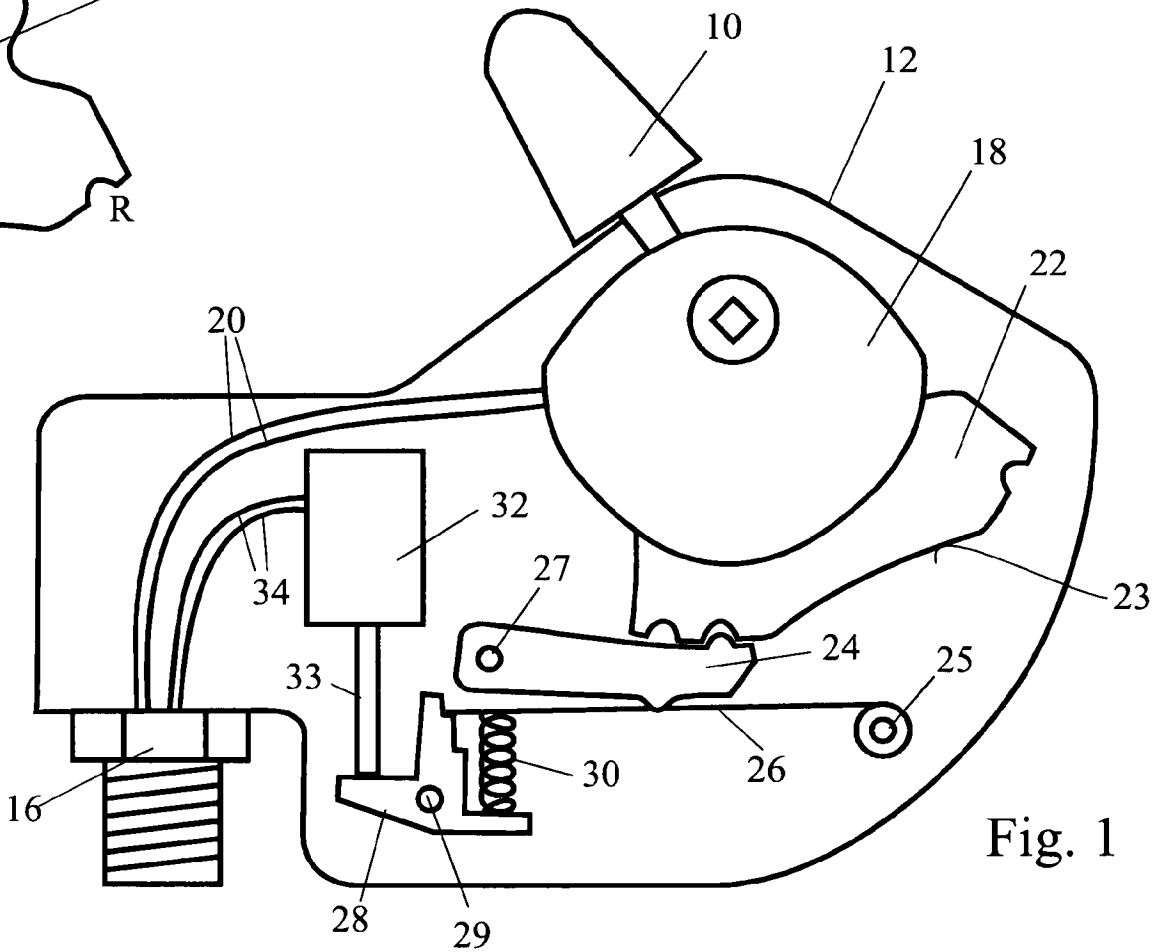
FIG. 1 is, as earlier described, a schematic representation of the interior of a four position switch in which the individual positions of the switch can be set to latched or momentary.
Figure 2:
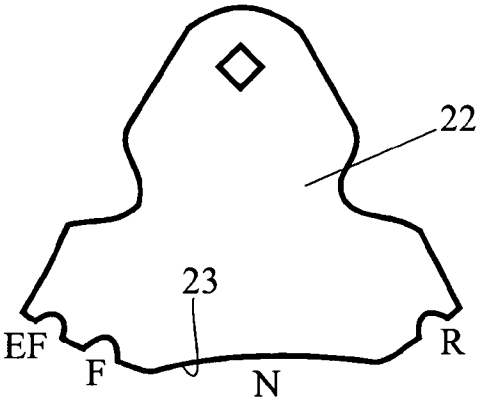
FIG. 2 shows the cam plate of FIG. 1.
Figure 3:
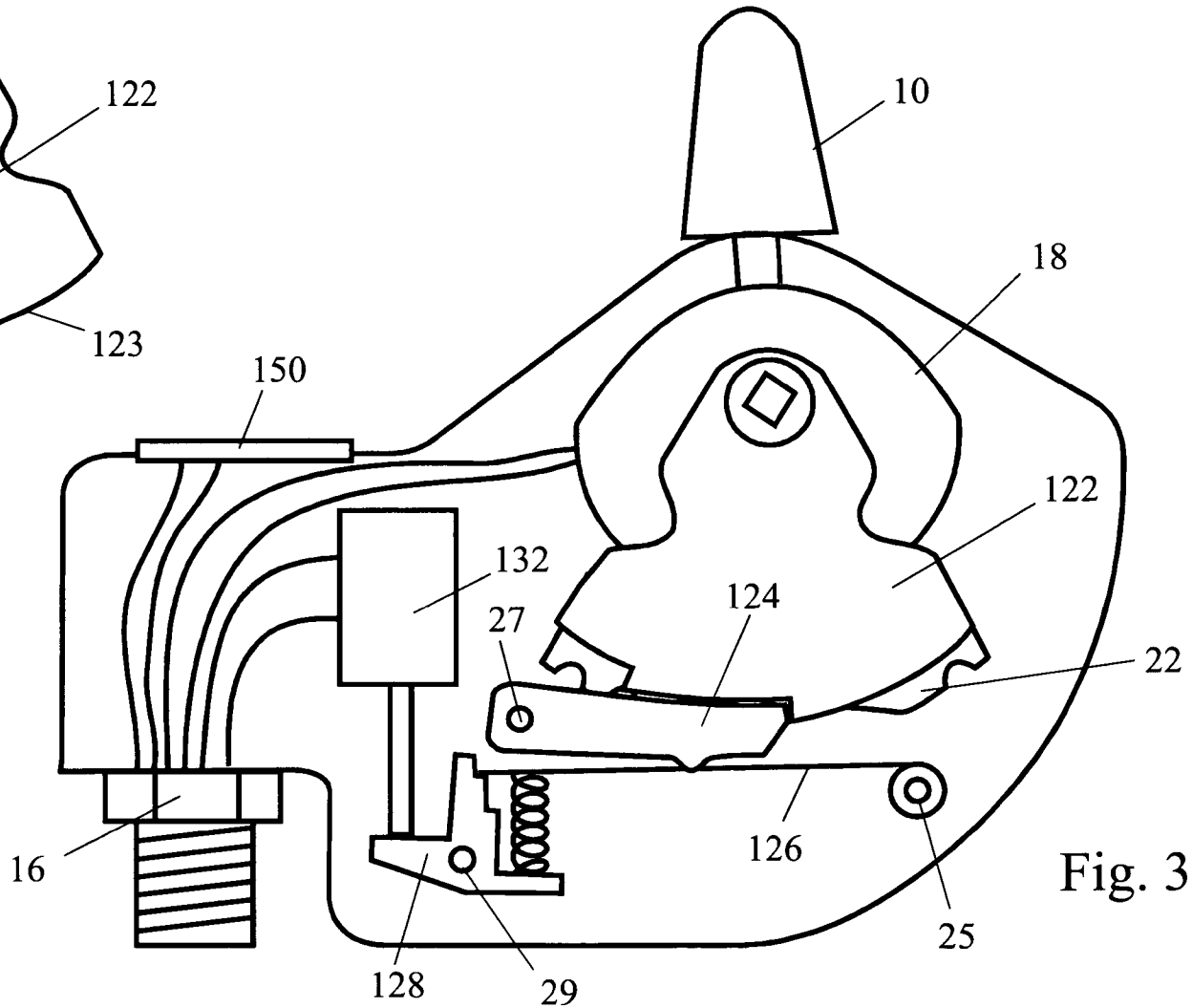
FIG. 3 is a view similar to that of FIG. 1 showing an embodiment of the invention.
Figure 4:
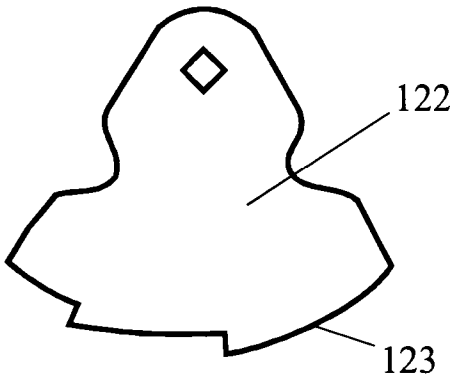
FIG. 4 shows the second cam plate of the embodiment of the invention shown in FIG. 3.

The configurable switch of FIG. 3 includes all the components described previously and these have been allocated the same reference numerals to avoid the need to describe them a second time. The main difference resides in the addition of a second cam plate 122 with a cam track 123 which interacts in the same manner as described previously with a detent 124, a spring plate 126, a catch 128 and a solenoid 132. These components obscure from view the detent 24, spring plate 26, catch 28 and solenoid 32 that interact with the first cam plate 22 and are still present.

The cam track 123 in this case has a cam profile resembling ratchet teeth which define stops interacting with a detent 126 which acts as a pawl. Hence, in the position illustrated in FIG. 3, the control lever 10 while in the neutral position can be pivoted only towards the forward and extended forward positions and is prevented from movement towards the reverse position. If the detent 124 engages the other ratchet tooth defined by the cam track 123, the control lever will only be able to move between the forward and extended forward positions and will be inhibited from reaching the neutral and reverse positions.

Hence, the cam 122 and the selective energizing of the solenoid 132 will determine the number of switch positions while the cam 22 and the selective energizing of the solenoid 32 will determine whether each of the switch positions is a latched or a momentary position.

In this way, the invention allows the same configurable switch to control any of the functions of a tractor and after its function has been selected the switch will operate in exactly the same way as a switch dedicated to that function.

A useful feature of the switch shown in FIG. 3 is that it additionally includes a display panel 150 to allow the function controlled by the switch to be displayed to the operator by means of a text message or preferably an icon.

Though described by reference to an electrical switch, it will be clear to the person skilled in the art that the switch module 18 could be replaced by hydraulic or pneumatic valves and that applications of the invention are not limited to tractors and agricultural vehicles.

The invention claimed is:

1. A remotely configurable control lever for operating an electrical switch on the control panel of an agricultural vehicle, comprising:

a cam plate rotatable with the control lever and having a cam track defining at least one notch;

a resiliently biased detent cooperating with the notch to latch the control lever in a predetermined position; and a solenoid for retracting the detent to allow the control lever to return to a neutral position;

wherein a second cam track is provided which is rotatable with the control lever and defines at least one stop cooperating with a retractable detent to limit the range of angular displacement of the control lever.

2. A control lever as claimed in claim 1, when used with a switch having neutral, reverse, forward and extended forward positions, wherein the second cam track is operative to prevent the control lever from moving to the reverse position when engaged by the detent and to enable the control lever to reach the reverse position when the detent is retracted.

3. A control lever as claimed in claim 2, wherein the second cam track has a second stop to inhibit the neutral and reverse positions of the control lever and only allow movement of the control lever between the forward and extended forward positions.

4. A control lever as claimed in claim 1 in combination with an electrical switch, wherein a display panel is mounted on a housing of the switch to indicate the function controlled by the switch.

* * * * *